US008708175B2

(12) United States Patent
Smith

(10) Patent No.: US 8,708,175 B2
(45) Date of Patent: Apr. 29, 2014

(54) TAMPER EVIDENT CLOSURE

(75) Inventor: Mark Smith, Cheltenham (GB)

(73) Assignee: Creanova Universal Closures, Ltd. (GB)

( * ) Notice: Subject to any disclaimer, the term of this patent is extended or adjusted under 35 U.S.C. 154(b) by 0 days.

(21) Appl. No.: 13/701,236

(22) PCT Filed: Jun. 3, 2011

(86) PCT No.: PCT/EP2011/059225

§ 371 (c)(1),
(2), (4) Date: Jan. 17, 2013

(87) PCT Pub. No.: WO2011/154324

PCT Pub. Date: Dec. 15, 2011

(65) Prior Publication Data

US 2013/0119061 A1 May 16, 2013

Related U.S. Application Data

(60) Provisional application No. 61/353,514, filed on Jun. 10, 2010.

(51) Int. Cl.
*B65D 43/16* (2006.01)
*B65D 41/34* (2006.01)

(52) U.S. Cl.
USPC ..... 215/235; 220/254.5; 222/556

(58) Field of Classification Search
USPC ..... 215/235, 237; 220/254.5, 4.23, 839, 220/254.3; 222/556
See application file for complete search history.

(56) References Cited

U.S. PATENT DOCUMENTS 7,073,679 B1 * 7/2006 Lagler et al. ..... 220/259.1

FOREIGN PATENT DOCUMENTS

| | | | |
|---|---|---|---|
| DE | 10 2004 045 511 | | 10/2005 |
| EP | 1 582 475 | A1 | 10/2005 |
| EP | 1 705 129 | | 9/2006 |
| GB | 2 454 926 | A | 5/2009 |
| WO | WO 2004/007313 | A1 | 1/2004 |
| WO | WO 2009/101117 | A1 | 8/2009 |

OTHER PUBLICATIONS

Machine translation of DE 10 2004 045 511 from esp@cenet. Sep. 2013.*

International Search Report dated Sep. 6, 2011 issued in corresponding International patent application No. PCT/EP2011/059225.

* cited by examiner

*Primary Examiner* — Anthony Stashick
*Assistant Examiner* — James N Smalley
(74) *Attorney, Agent, or Firm* — Ostrolenk Faber LLP

(57) ABSTRACT

Closure (1) comprising a ring shaped base (12) laterally surrounding a cap (13) which is functionally interconnected to the ring shaped base (12) via a hinge arrangement (14), whereby the ring shaped base (12) is having an in general horizontal section (15) on which a first end of the hinge arrangement (14) is fixed protruding vertically (z) above the horizontal section (15) of the ring shaped base (12) and whereby a second end of the hinge arrangement (14) is laterally fixed to an outer sidewall (30) of the cap (13).

7 Claims, 3 Drawing Sheets

TAMPER EVIDENT CLOSURE

CROSS REFERENCE TO RELATED APPLICATIONS

The present application is a 35 U.S.C. §371 National Phase conversion of PCT/EP2011/059225, filed Jun. 3, 2011, which claims the benefit of U.S. Provisional patent application no. 61/353,514, filed Jun. 10, 2010, the disclosure of which is incorporated herein by reference. The PCT International Application was published in the English language.

BACKGROUND

1. Field of the Invention

The present invention relates to a closure, especially a hinged closure for a container for liquids such as beverages.

2. Related Art

In the prior art hinged closures made out of plastic material are known for the sealing of containers for drink packages. Especially in the field of soft drinks or still water with disposable packages hinged closures are popular.

WO2004/007313 was published in January 2004 and is directed to a two-part closure comprising a hinged cap. The closure comprises a base portion with two different diameters and a cap portion, which is snapped onto the base portion at the smaller diameter around a spout. Between the larger and the smaller diameter a shoulder is formed. The cap portion comprises a top and a ring, which are interconnected to each other via a flimsy dead hinge having no snap effect.

EP1705129 was published in 2006 and is directed to a plastic closure comprising a base portion and an cap portion, which is snapped onto the base portion. The top portion comprises a ring shaped lower part and a cap. The cap is interconnected to the ring shaped lower part through a snap hinge arrangement, which laterally protrudes above the side wall of the closure. The hinge arrangement comprises a main hinge connection, which interconnects the closure parts, i.e. the closure parts are moving relatively to each other on a circular path. Due to the type of hinge connection the relative movement is very limited. A further draw back can be seen in the weakness of the hinge.

EP1582475 was published in 2005 and discloses a tamper evident closure assembly. The closure comprises a reclosable protective cap having a smaller diameter with respect to a base collar. The base collar being interconnected through a hinge element and a series of freely breakable elements. One disadvantage of this closure can be seen in the limited functionality and the small size of the hinge.

WO2009/101117 of the same applicant as the herein described invention was published in 2009 and is directed to a closure having an external snap hinge. The closure can be made in a closed position. It comprises a lower part and an upper part, which are interconnected to each other by an external hinge arrangement. The external hinge arrangement comprises a first articulation element interconnected to the lower closure part, a second articulation element interconnected to the upper closure part and at least one intermediate element interconnected to the first and the second articulation element by a film hinge.

SUMMARY OF THE INVENTION

One aim of the invention is to provide an improved hinged closure for containers, which overcomes the drawbacks known from prior art. A further aim of the invention is to provide a closure having an improved tamper evidence and functionality.

A preferred closure according to the herein disclosed invention in general comprises a lower part with a pouring spout, which in a closed position is covered by an upper part. The upper part normally comprises a ring-shaped base and a cap. The cap and the ring-shaped base are integrally interconnected to each other through a snap hinge arrangement preferably without a main hinge connection between the ring-shaped base and the cap. The hinge arrangement is arranged above a shoulder of the lower part beside the pouring spout. The hinge arrangement preferably does not protrude above the outer diameter of the lower part of the closure, whereby the visible appearance of the closure can be improved.

The ring-shaped base of the upper part is normally snapped onto the lower part at the upper end, whereas the lower part is then foreseen to be affixed onto the rim of an opening of a container. The parts can be interconnected to each other in an other way. In an embodiment the lower part is designed relatively short and foreseen to be laterally encompassed by the ring-shaped base of the upper part, which is foreseen to be affixed to the outer rim of an opening of the container.

An embodiment of the invention is directed to a closure comprising a ring shaped base laterally surrounding a cap, which is functionally interconnected to the ring shaped base via a hinge arrangement. The ring shaped base is having an in general horizontal section, on which a first end of the hinge arrangement is fixed protruding vertically above the horizontal section of the ring shaped base. A second end of the hinge arrangement is laterally fixed to an outer sidewall of the cap. The ring shaped base and the cap (together forming an upper part) may be attached to a lower part of the closure comprising a spout with a pouring opening, whereby the cap is in a closed position interacting with the spout sealing the pouring opening of the spout. The hinge arrangement in a top view may be arranged completely inside the outer diameter of the ring shaped base. This improves the design and the handling of the closure during application. The hinge arrangement may comprise at least one in general L-shape arm. The at least one L-shaped arm may comprise at least one hinge. The hinge arrangement may comprise two L-shaped arms arranged laterally at a distance to each other, each L-shaped arm comprising a first articulation element fixed to the ring shaped base and a second articulation element fixed to the cap and whereby each articulation element is interconnected to a trapezoid element via a hinge. The articulation elements and the trapezoid element are preferably designed sufficient stiff such that the hinge arrangement can transmit mechanical forces without hindering deformation. In a top view, the two L-shaped arms may be arranged at an angle a with respect to each other. The angle $\alpha$ may be positive such that the L-shaped arms in the top view follow the outer contour of the closure or negative such that they diverge. The ring shaped base and the cap may be interconnected by frangible bridges indicating initial opening of the closure. Alternatively or in addition a tear-off band may be foreseen, which needs to be removed for initial opening of the closure. The cap may comprise a tab, which is interconnected to the ring shaped base by a frangible web of material. The tab serves as a second means to indicate initial opening.

BRIEF DESCRIPTION OF THE DRAWINGS

The herein described invention will be more fully understood from the detailed description given herein below and the accompanying drawings, which should not be considered limiting to the invention described in the appended claims. The drawings are showing:

DESCRIPTION OF THE EMBODIMENTS

Figure 1:
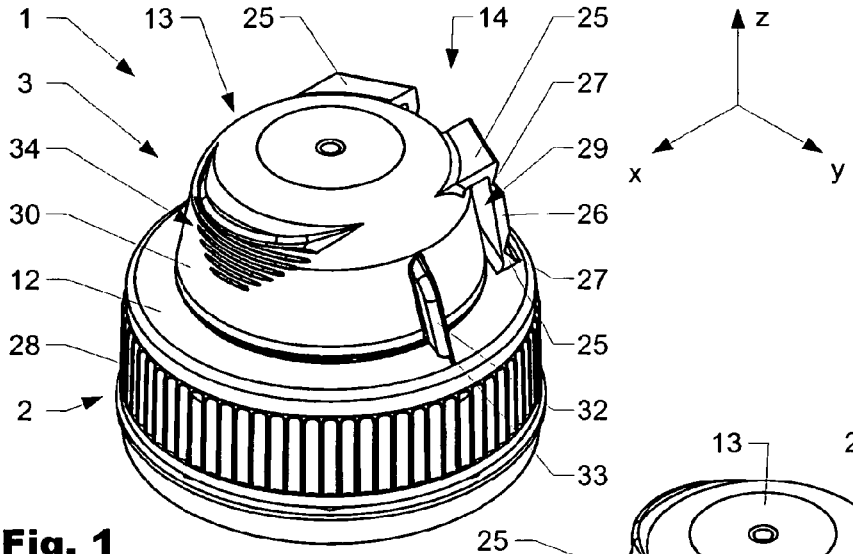
FIG. 1 A closure in a perspective manner from forward and above.
Figure 2:
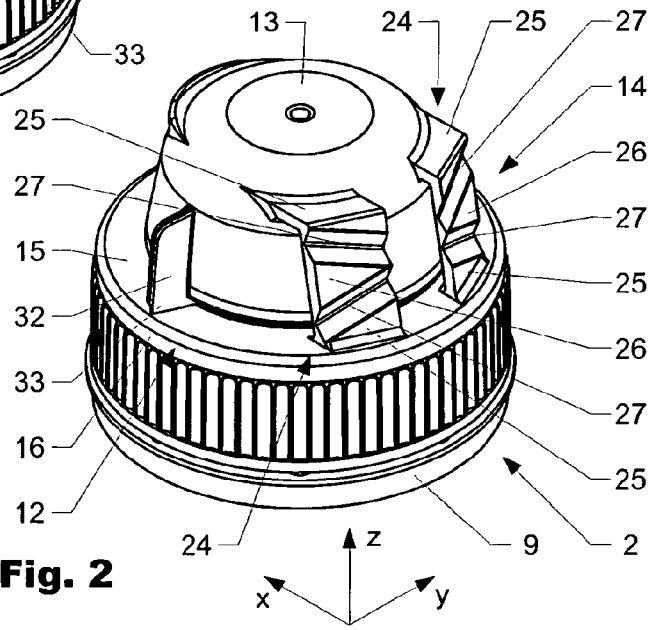
FIG. 2 The closure according to FIG. 1 from backward and above.
Figure 3:
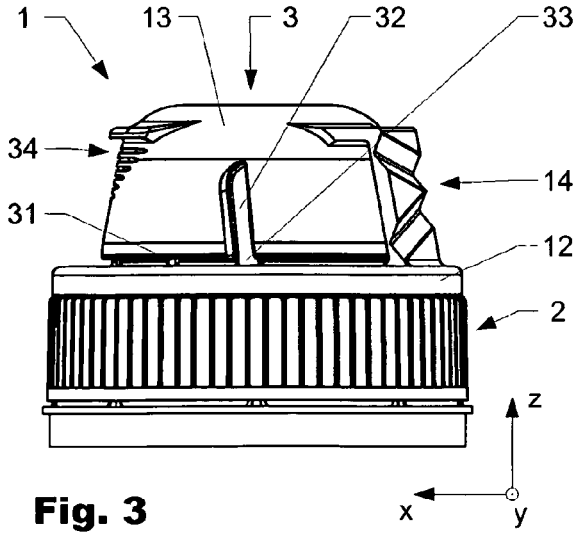
FIG. 3 The closure according to FIG. 1 in a side view.
Figure 5:
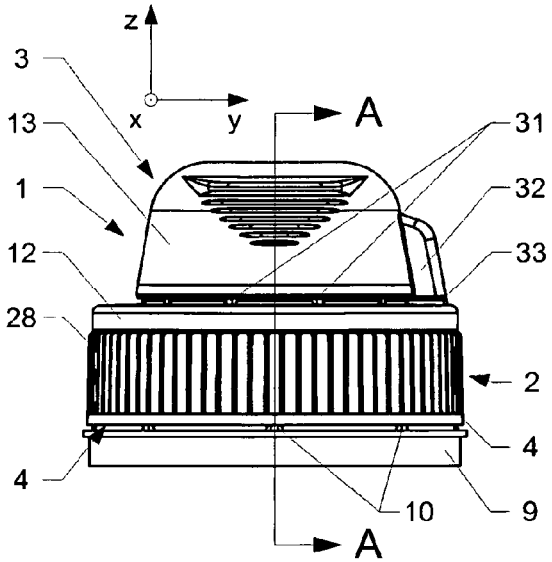
FIG. 5 The closure according to FIG. 1 in a front view.
Figure 6:
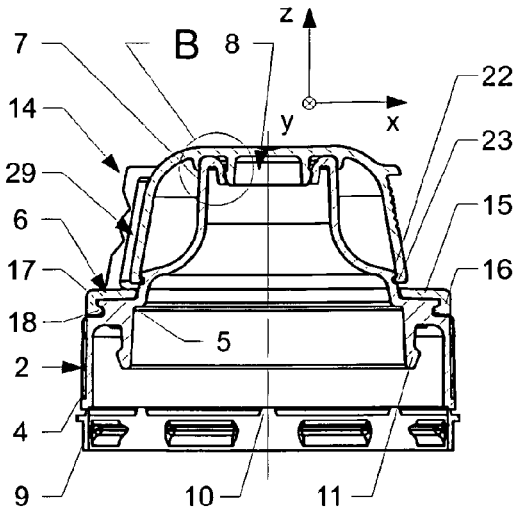
FIG. 6 A section through the closure according to FIG. 5 along section line AA.
Figure 7:
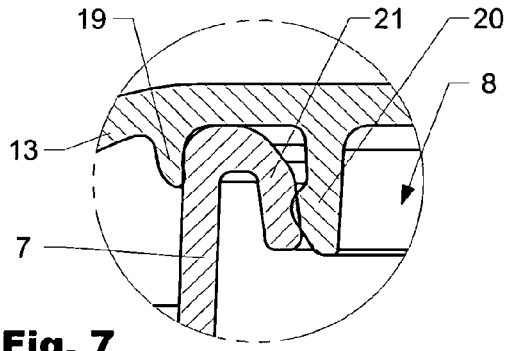
FIG. 7 Detail B according to FIG. 6.
Figure 8:
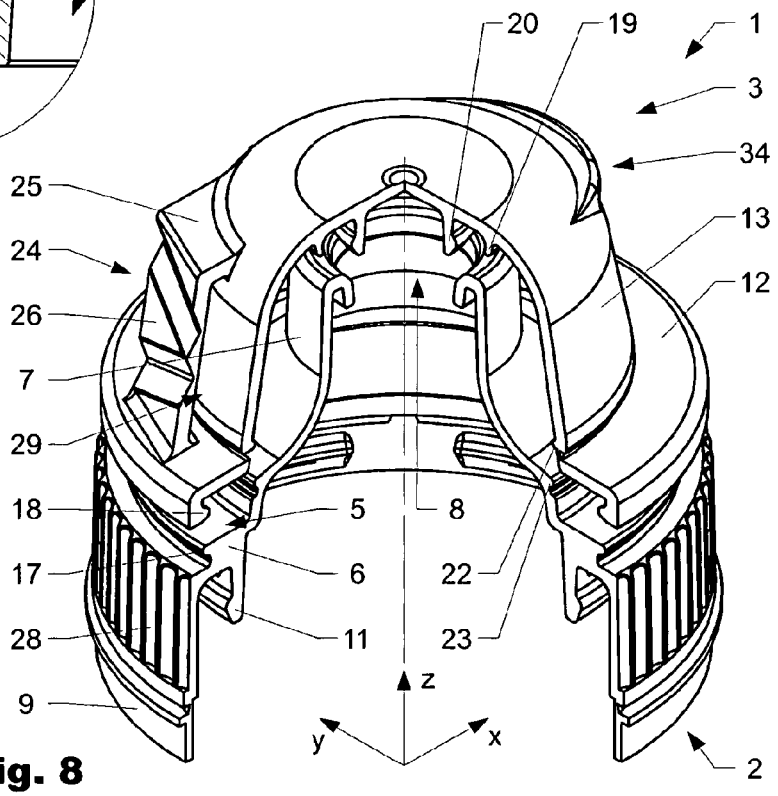
FIG. 8 A partially cut and disassembled closure in a perspective view.

FIG. 1 shows an example of a closure 1 according to the invention in a perspective view from forward and above. FIG. 2 shows the same closure in a perspective manner from rear and above. FIG. 3 shows the same closure in a side view from the left and FIG. 4 in a top view. FIG. 5 shows the closure in a front view and FIG. 6 shows a cross-section of the closure according to the section-line AA as indicated in FIG. 5. FIG. 7 shows Detail B of FIG. 6. FIG. 8 shows the closure in a partially cut and disassembled manner from rear and above.

The closure 1 comprises a lower part 2 and an upper part 3. The upper part 3 is normally snapped onto the lower part 2. The lower part 2 comprises an outer side wall 4. At the upper end the outer side wall 4 merges into a top section 5, forming a shoulder 6. A spout 7 vertically (z-direction) protrudes above the top section 5, which forms at it's top end a pouring opening 8. At the lower end a tamper band 9 is interconnected to the outer side wall 4 via first frangible bridges 10. The frangible bridges 10 are foreseen to indicate initial opening of the closure 1. Instead of frangible bridges 10 a thin web of material can be foreseen.

As it can be seen in the cross-section according to FIG. 6, the lower part 2 comprises a seal 11, which is foreseen to in a mounted position interact with a neck of a bottle (both not shown). In the shown example the seal 11 is a bore seal. Alternatively or in addition other sealing-systems can be applied.

At the inside of the outer side wall 4 fastening means are fit, which allow to attach the lower part 2 to the neck of the bottle. The fastening means (which are not shown) can be a thread or a rim protruding inwardly above the inner surface, which allows to snap-on the closure. Other fastening means are possible. At the outside the outer sidewall 4 comprises knurls 28, which provide a better grip of the closure.

The upper part 3 comprises a ring-shaped base 12 and a cap 13, which are interconnected to each other via a hinge arrangement 14. The ring-shaped base 12 of the herein shown embodiment comprises a horizontal section 15 and a vertical section 16, which are arranged tight-fitting around the shoulder 6 of the lower part 2. The base 12 is attached to the lower part 2 via a snap-fit formed by a first and a second bead 17, 18, which in a mounted position (as shown e.g. in FIG. 6) engage behind each other. The upper part is normally made by injection moulding in a closed position.

The cap 13 interacts with the spout 7 in the area of the pouring opening 8 and at the base of the spout 7. As it can be seen in FIG. 7, in the area of the pouring opening 8, the cap comprises an outer seal 19 and an inner seal 20. The outer seal 19 tightly encompasses the inwardly bend upper rim 21 of the spout 7, which forms the pouring opening 8. While the outer seal reaches down along the spout 7 and interacts with the side wall of the spout 7 from the outside, the olive shaped inner seal 20 reaches down into the pouring opening 8 interacting from the inside with the upper rim 21. Depending on the field of application other sealing systems may be appropriate. The herein shown sealing system may be appropriate for other closure applications.

At the lower end, the cap 13 interacts with the base of the spout 7 through a snap fit formed by third and a fourth bead 22, 23 forming a tight connection between the lower part 2 and the cap 13 of the upper part 3. Because thereby the spout area may be hermetically sealed, it becomes possible to rinse the closure by a cleansing fluid without the danger that unwanted remains of the cleansing fluid may become trapped.

The hinge arrangement 14 is arranged standing above and adjacent to the horizontal section 15 of the base 12 and it is interconnected to the cap 13 from the outside. The hinge 13 of the shown embodiment consists of two in general arms 24, which are—when viewed in a side direction—in general L-shaped. Each arm comprises a first and a second articulation element 25, which each are functionally interconnected to a trapezoid element 26 via hinges 27 (film hinges formed by a thin web of material). The hinges 27 and the arms 24 are arranged to with respect to each other such that they provide a snap hinge comprising a first and a second stable position. The hinge arrangement 14 of the shown embodiment does not provide a direct main hinge connection forming a single point of rotation between the base 12 and the cap 13. The herein shown hinge arrangement 14 is of the type of a double hinge arrangement, providing a large opening angle, which cannot be achieved by a conventional hinge arrangement having a main hinge connection between the base an the cap. By the shown hinge arrangement 14 opening angles larger than 180° can be achieved. As it can be seen, the trapezoid elements 26 are separated by a gap 29 from an outer side wall 30 of the cap 13. The gap 29 is shaped that it can be demoulded easily.

A further advantage of the shown embodiment of closure 1 is the improved tamper evidence. Initial opening is indicated by two systems. A series of frangible bridges (second frangible bridges) 31 are connecting the ring-shaped base 12 and the cap 13 before initial opening. The second bridges 31 are integrally moulded when making of the top part 3. A side tab 32 is arranged at the side wall 30 of the cap 13. The tab 32 is interconnecting the base 12 with the cap 13 through a frangible web of material 33 foreseen to be destroyed during initial opening of the cap 13. A consumer pushes the side tab 32 away towards the hinge arrangement 14 (or in opposite direction). During this pushing motion a tear occurs along the frangible web of material 33 at the underside of the side tab 32, breaking the connection between the cap 13 and the base 12 of the upper part 3. Due to tearing and deformation of the plastic material it is not possible for the tab to completely return to its original position and reform a connection between cap 13 and base 12. This provides a visual tamper evidence for the consumer. The consumer can then open the cap 13 by pushing upward against a finger recess 34 at the front of the cap 3. The rotation about the hinge arrangement 14 causes the second bridges 31 to break, allowing access to the pouring opening 8 of the spout 7.

Figure 4:
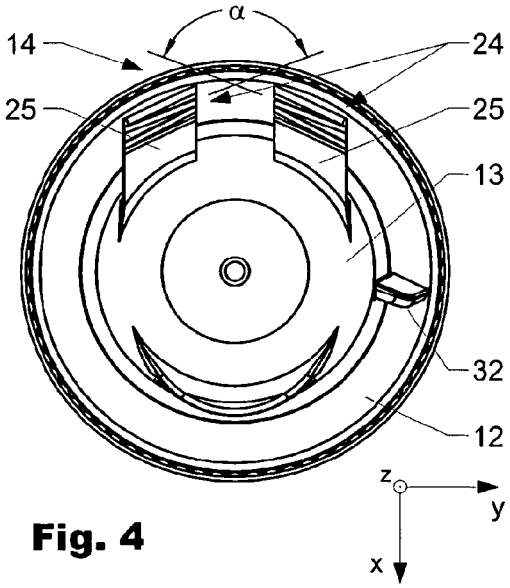
FIG. 4 The closure according to FIG. 1 in a top view.

As it can be seen in the top view according to FIG. 4, the L-shaped arms 24 are arranged at an angle $\alpha$ with respect to each other, which in the present example is positive, i.e. the I-shaped arms are arranged in an in general tangential direction. In an other embodiment, a negative angle α is possible with the result that the L-shaped arms 24 would diverge with respect to the outer contour of the cap 13. This offers the advantage that the film hinges 27 can be arranged inside gap 29 reducing the visibility from the outside.

In FIG. 8 the lower part 2 and the upper part 3 of closure 1 are shown disassembled in vertical direction (z-axis) above each other. Part of the closure is cut away, such that the inside of the closure is better visible. The closure parts 2, 3 are shown shortly before the snap fit between the first and the second bead 17, 18 is established by vertically pushing the upper part 3 onto the lower part 2.

Figure 9:
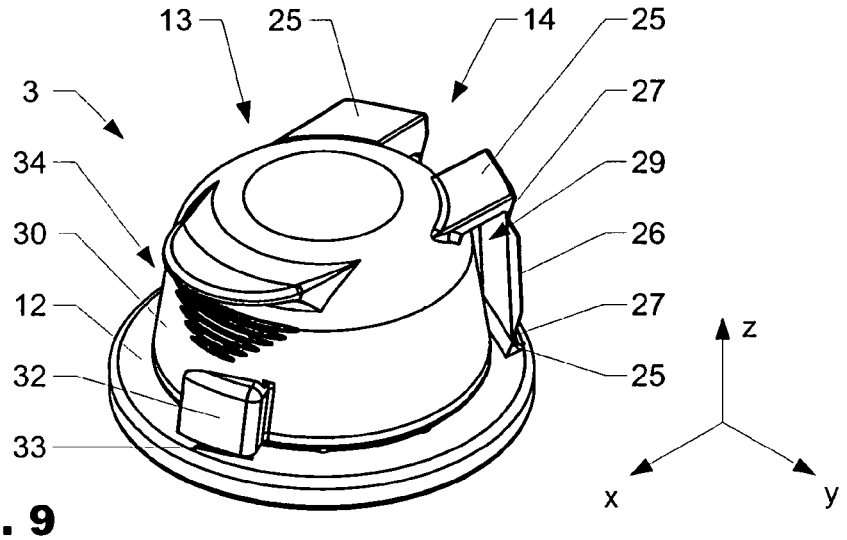
FIG. 9 A further embodiment of a closure according to the present invention.
Figure 10:
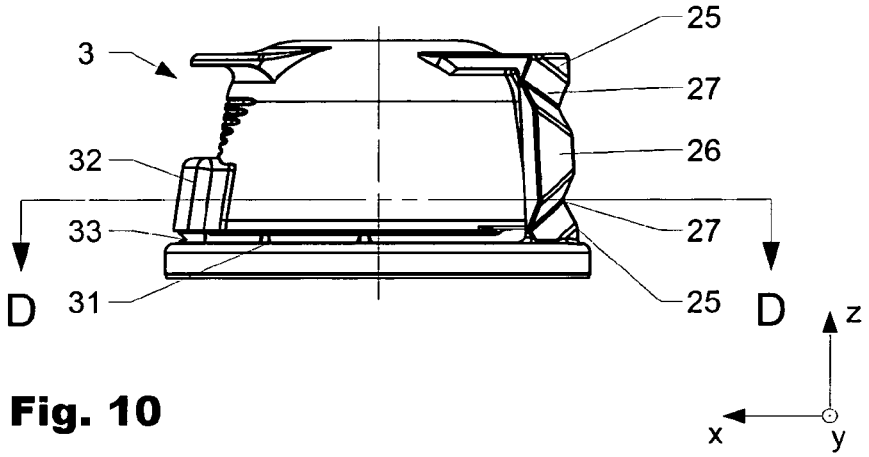
FIG. 10 The closure according to FIG. 9 in a side view.
Figure 11:
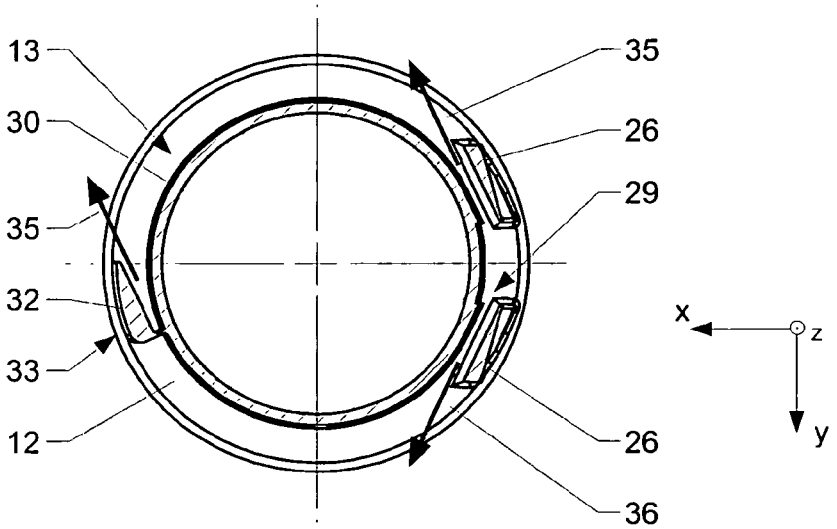
FIG. 11 A section view of the closure according to FIG. 10 along section line D-D.

FIG. 9 shows a further embodiment of an upper part 3 in a perspective view. FIG. 10 is showing the same upper part in a side view and FIG. 11 is showing the upper part in a section view along section line DD of FIG. 10. For the general description of the shown upper part 3 it is referred to the description of the previous drawings which in general apply here too and is therefore not repeated again.

The gap 29 between the trapezoid elements 26 and the outer side wall 30 of the cap 13 is designed demoldable—e.g. parallel or slightly conical—in the direction of the arrows 35, 36 schematically indicating the movement of slides of a mold (both not shown) for manufacturing of the upper part 3. The same applies for the tap 32 and the frangible web of material 33 which interconnects the tap 32 and the base 12. The shown embodiment has the advantage that it easily can be manufactured. The movement of the slides 35, 36 is made tangential to the inside of the hinge arrangement 14 and the cap 13. One advantage is that the tap 32 is arranged off-set from the centre of the cap 13. This means that when the tab is in the original unbroken position it covers the thumb-up area 34 directly beneath the overcap lip. When the tab 32 is in the broken position, the tab 32 is located to the side leaving said area 34 under the lip clear for thumb-up operation to open the cap 13.

LIST OF REFERENCES

| | |
|---|---|
| 1 | Closure |
| 2 | Lower part |
| 3 | Upper part |
| 4 | Outer side wall |
| 5 | Top section |
| 6 | Shoulder |
| 7 | Spout |
| 8 | Pouring opening |
| 9 | Tamper band |
| 10 | First frangible bridges |
| 11 | Seal |
| 12 | Base (of upper part) |
| 13 | Cap |
| 14 | Hinge arrangement |
| 15 | Horizontal section (base 12) |
| 16 | Vertical section (base 12) |
| 17 | First bead |

-continued

LIST OF REFERENCES

| | |
|---|---|
| 18 | Second bead |
| 19 | Outer seal (Cap 13) |
| 20 | Inner seal (Cap 13) |
| 21 | Upper rim |
| 22 | Third bead |
| 23 | Fourth bead |
| 24 | L-shaped arm (Hinge 14) |
| 25 | Articulation element |
| 26 | Trapezoid element |
| 27 | Hinge (film hinge) |
| 28 | Knurl |
| 29 | Cap |
| 30 | Outer side wall (cap 13) |
| 31 | Second frangible bridges |
| 32 | Tab (side tab) |
| 33 | Frangible web of material |
| 34 | Finger recess |
| 35 | First Slide, movement |
| 36 | Second Slide, movement |

What is claimed is:

1. A closure comprising:

a ring shaped base and a cap, said cap being functionally interconnected to the ring shaped base via a hinge arrangement, wherein the ring shaped base having a generally horizontal section on which a first end of the hinge arrangement is fixed protruding vertically above the horizontal section of the ring shaped base, wherein a second end of the hinge arrangement is laterally fixed to an outer sidewall of the cap, wherein the hinge arrangement comprises two L-shaped arms arranged laterally at a distance to each other, each L-shaped arm comprising a first articulation element fixed to the ring shaped base and a second articulation element fixed to the cap, and wherein each articulation element is interconnected to a trapezoid element via a hinge.

2. Closure according to claim 1, wherein the ring shaped base is attached to a lower part of the closure comprising a spout with a pouring opening, whereby the cap is in a closed position interacting with the spout sealing the pouring opening.

3. Closure according to claim 1, wherein the hinge arrangement in a top view is arranged completely inside the outer diameter of the ring shaped base.

4. Closure according to claim 1, wherein the two L-shaped arms are arranged at an angle α with respect to each other.

5. Closure according to claim 1, wherein the ring shaped base and the cap are interconnected by frangible bridges.

6. Closure according to claim 1, wherein the cap comprises a tab, which is interconnected to the ring shaped base by a frangible web of material.

7. Closure according to claim 1, wherein a tear-off band is foreseen, which needs to be removed for initial opening of the closure.

* * * * *